US007026886B2

(12) United States Patent
Tzuang et al.

(10) Patent No.: US 7,026,886 B2
(45) Date of Patent: Apr. 11, 2006

(54) MINIATURIZED MICROWAVE INTEGRATED CIRCUIT USING COMPLEMENTARY CONDUCTING SURFACES

(75) Inventors: Ching-kuang Tzuang, Hsinchu (TW); Chih-chiang Chen, Taipei (TW)

(73) Assignee: National Chiao Tung University (TW)

( * ) Notice: Subject to any disclaimer, the term of this patent is extended or adjusted under 35 U.S.C. 154(b) by 202 days.

(21) Appl. No.: 10/684,037

(22) Filed: Oct. 9, 2003

(65) Prior Publication Data

US 2005/0077979 A1 Apr. 14, 2005

(51) Int. Cl.
*H01P 5/12* (2006.01)

(52) U.S. Cl. ..... 333/125; 333/116; 333/238; 333/239; 333/248

(58) Field of Classification Search ..... 333/116, 333/117, 125, 238, 239, 248
See application file for complete search history.

(56) References Cited

U.S. PATENT DOCUMENTS 2,769,148 A * 10/1956 Clogston ..... 333/236
4,918,411 A * 4/1990 Staehlin et al. ..... 333/239
5,382,931 A * 1/1995 Piloto et al. ..... 333/208
5,770,988 A * 6/1998 Goto et al. ..... 333/236
6,104,264 A * 8/2000 Ishikawa et al. ..... 333/239
6,148,221 A * 11/2000 Ishikawa et al. ..... 505/210
6,515,562 B1 * 2/2003 Takenoshita et al. ..... 333/248
6,518,864 B1 * 2/2003 Ito et al. ..... 333/238

* cited by examiner

*Primary Examiner*—Benny Lee
*Assistant Examiner*—Kimberly Glenn
(74) *Attorney, Agent, or Firm*—Martine Penilla & Gencarella, LLP

(57) ABSTRACT

The invention discloses a two-dimensional array waveguide structure implemented with multi-layer process or monolithic integrated circuit process. The structure includes a first metal layer, a second metal layer and a dielectric layer. The dielectric layer lain between the first and the second metal layer is for isolating the first metal layer from the second metal layer. The first metal layer and the second metal layer respectively formed from a plurality of first unit cells and second unit cells arranged in rows and columns create the two-dimensional array waveguide structure. The first metal layer consists of a main body and a plurality of connecting arms, whereas the second metal layer consists of a metal wire loop. The second metal layer is located below the first metal layer, and each second unit cell corresponds to each first unit cell in a one-on-one manner to further build a complete unit cell. While the main body of each unit cell corresponds to an inductance element, the connecting arms of each unit cell linking the adjacent unit cells correspond to a capacitance element; therefore, a two-dimensional L-C array is formed.

14 Claims, 16 Drawing Sheets

MINIATURIZED MICROWAVE INTEGRATED CIRCUIT USING COMPLEMENTARY CONDUCTING SURFACES

BACKGROUND OF THE INVENTION (a) Field of the Invention

The invention relates to a two-dimensional array waveguide structure, and more particularly, to a two-dimensional array waveguide structure formed by multi-layer circuit process or monolithic integrated circuit process for accomplishing a miniaturized microwave integrated circuit.

(b) Description of Related Art

Miniaturization of microwave integrated circuits has been a research subject for microwave integrated circuit engineers and researchers. Large amounts of distributed elements are employed in microwave circuits, whereas the largest dimensions of the distributed elements approach the wavelengths corresponding to actual operating frequencies such that reducing dimensions of microwave circuits is rather hard to achieve.

One of the most common methods for reducing dimensions is to make a microwave circuit into a monolithic integrated circuit. The thickness of a substrate of a monolithic microwave integrated circuit (MMIC), and dimensions of planar or coplanar waveguide printed on the substrate, may all be reduced three-dimensionally in scale. For example, a typical MMIC formed on a gallium arsenide substrate with a $\epsilon_r$ coefficient of 12.9 has a substrate thickness to be approximately 100 μm. However, a similar hybrid microwave integrated circuit using a substrate with a $\epsilon_r$ coefficient of 10.5 and a thickness of 250 μm, has a waveguide line width or a line gap of $^{250}/_{100}\times(\sqrt{12.9+1}/\sqrt{10.5+1})$ times of the former. It is assumed that a propagation constant of the transmission line can be appropriately enlarged and reduced without drastic changes (Maxwell's equation appears to be linear, and hence the above hypothesis should be able to establish). Therefore, the area of a monolithic microwave integrated circuit, can be $0.4\times(\sqrt{10.5+1}/\sqrt{12.9+1})\approx 36\%$ times smaller than that of the hybrid integrated circuit using a thicker substrate (K. C Gupta, Ramesh Garg, Inder Bahl, and Prakash Bhartia, "Microstrip lines and Slotlines", Artech House, Boston London, 1996).

Apart from allowing three-dimensional size reduction, researchers have also utilized lumped elements for serving as quasi-waveguide elements to manufacture passive elements or circuits (George L. Matthaei, Stephan M. Rohifing, Roger J. Forse, "Design of HTS, lumped-element, manifold-type microwave multiplexers", *IEEE Trans. Microwave Theory Tech.* vol. 44, pp. 1313–1321, July 1997). Because it is essential that dimensions of a lumped element be much smaller than wavelengths of operating frequencies, the circuit area of an entire passive element is substantially reduced. Lumped elements used as quasi-waveguide elements generally have smaller operating frequency ranges, and are unsuitable for wide-band applications.

Moreover, the characteristic of a wavelength $\lambda_g$ of a slow-wave transmission line much smaller than $\lambda_0$ ($\lambda_0$ is the wavelength of light velocity, or the wavelength of electromagnetic waves in vacuum) can also be utilized to reduce areas of microwave integrated circuits. The semiconductor portion at the lower section of a microstrip made from a metal-insulator-semiconductor (MIS) transmission line is doped to change distributions of electric field and magnetic field of the microstrip, such that a slow-wave factor (SWF), $\lambda_0/\lambda_g$, is significantly increased (D. Jäger, "Slow-wave propagation along variable Schottky-contact microstrip line," *IEEE Trans. Microwave Theory Tech.*, vol. MTT-24, pp. 566–573, September 1976. H. Ogawa and T. Itoh, "Slow-Wave Characteristics of Ferromagnetic Semiconductor Microstrip Line," *IEEE Trans. Microwave Theory Tech.*, vol. MTT-34, pp. 1478–1482, December 1986). Semiconductor processes can produce slow-wave lines having an SWF greater than 10. However, loss of these MIS slow-wave lines are greatly increased due to existence of doping, and such additional loss prohibits extensive applications of the MIS slow-wave lines. Based upon principles similar to those of MIS slow-wave lines, partially changing electric field and magnetic field distributions of transmission lines may also accomplish increase of the SWF. A periodic structure like coplanar waveguide adopts a cross-tie structure to partially produce capacitive loading to further change electric field and magnetic field directions of the waveguide. According to documented records, a SWF as high as 11.6 can be obtained (T. H. Wang and T. Itoh, "Compact grating structure for application to filters and resonators in monolithic microwave integrated circuits," *IEEE Trans. Microwave Theory Tech.*, vol. 35, pp. 1176–1182, December 1987). Using similar principles, the cross-tie can be reversed by connecting itself with a lower metal layer to produce capacitive loading with respect to the coplanar waveguide, and thus a high SWF of 8 can be achieved according to other references (U.S. Pat. No. 4,340,873).

SUMMARY OF THE INVENTION

The object of the invention is to provide a novel two-dimensional array waveguide structure implemented by multi-layer circuit process or monolithic circuit process for accomplishing miniaturization of a microwave integrated circuit.

Another object of the invention is to extend applications of the novel two-dimensional array waveguide structure to ring couplers.

The other object of the invention is to utilize the novel two-dimensional array waveguide structure, without changing thicknesses of a substrate and a metal, to change a slow-wave factor (SWF) and characteristic impedance of an entire L-C transmission line by adjusting cell shapes and microstrip dimensions.

According to the invention, a two-dimensional array waveguide structure includes a first metal layer, a second metal layer and a dielectric layer. The first metal layer consists of at least a first sub metal layer. Adjacent first sub metal layers are isolated by a dielectric layer lain in between, and the dielectric layer is perforated with a plurality of openings and filled with a metal. Each first sub metal layer is formed by a plurality of first unit cells arranged in rows and columns, so as to form a two-dimensional array structure. Each first unit cell has a main body and a plurality of connecting arms that join adjacent first unit cells together.

The second metal layer consists at least a second sub metal layer. Adjacent second sub metal layers are isolated by a dielectric layer lain in between, and the dielectric layer is perforated with a plurality of openings and filled with a metal. Each second sub metal layer is formed by a plurality of second unit cells arranged in rows and columns, so as to form a two-dimensional array structure. The second metal layer is situated below the first metal layer. Each second unit cell is corresponding to each individual first unit cell in a one-on-one manner, and adjacent second unit cells are joined with one another. Each second unit cell is made of a metal wire loop. The dielectric layer is provided between the second metal layer and the first metal layer to isolate the second metal layer from the first metal layer.

The invention is characterized that, the entire two-dimensional array waveguide structure may be regarded as an L-C periodic structure wherein the main body of each unit cell is corresponding to an inductance element, and the connecting arm joining the adjacent unit cells is corresponding to a capacitance element for forming a two-dimensional L-C array with non-uniform cross-section along the periodic wave propagation. Equivalent inductance is varied with dimension changes of the unit cells, while equivalent capacitance of the connecting arm joining cells together also varies with the width and length of the connecting arm. Therefore, by changing shapes and dimensions of the aforesaid cells and connecting arms, propagation characteristics of the periodic structure can be changed. Provided that thicknesses of the substrate and metal remain unchanged, SWF and characteristic impedance of the entire L-C transmission line are changed by adjusting the design of the unit cells.

BRIEF DESCRIPTION OF THE DRAWINGS

FIG. 13 shows an output simulation diagram of FIG. 11; wherein, FIG. 13A shows matching frequency response of an input end with an external impedance of 50 Ω, FIG. 13B shows matching frequency response of an output end with an external impedance of 50 Ω, and FIG. 13C shows matching frequency response of gain.

FIG. 16 shows an output simulation diagram of FIG. 14; wherein.

DETAILED DESCRIPTIONS OF THE PREFERRED EMBODIMENT

[First Embodiment]

Figure 1A:
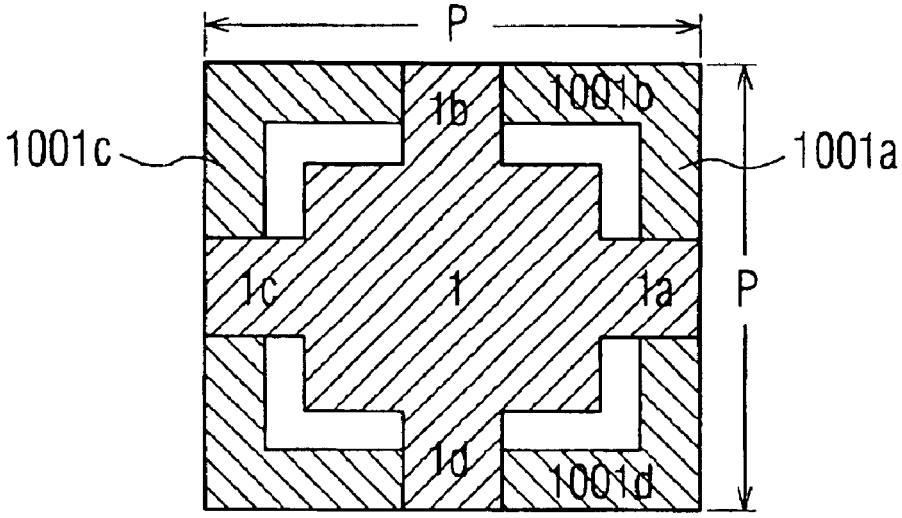
FIGS. 1A and 1B are a top view and a perspective view showing a unit cell forming a two-dimensional array, respectively.
Figure 1B:
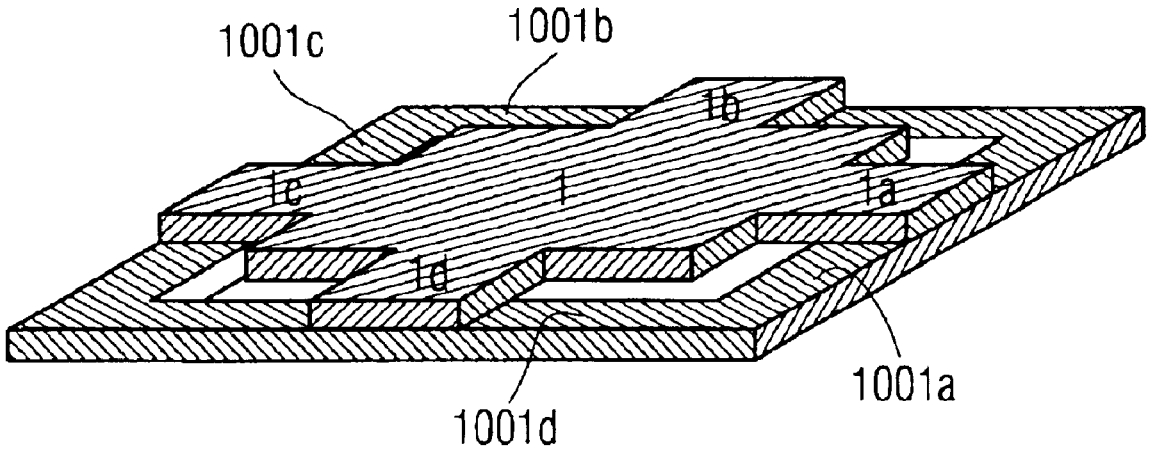

FIGS. 1A and 1B are a top view and a perspective view showing a design of a cell formed in an array. The area with right slanted lines (lines drawing from an upper right corner to a lower left corner) represents an upper metal layer pattern of a two-layer microwave substrate; the area with left slanted lines (lines drawing from an upper left corner to a lower right corner) represents a lower metal layer pattern of the two-layer microwave substrate. The area with right slanted lines (the upper metal layer pattern) consists of two elements, which are a main body 1, and connecting arms 1*a*, 1*b*, 1*c* and 1*d* arranged in counterclockwise and connecting four sides of the main body 1. The area with left slanted lines (the lower metal layer pattern) consists of a square loop formed by four connecting arms 1001*a*, 1001*b*, 1001*c* and 1001*d*. The square cells are arranged in rows and columns to form a two-dimensional array. The upper and lower metal layers are adhered to the substrate, and have a relative dielectric constant $\epsilon_r$ generally in the range between 1 and 20.

Figure 2A:
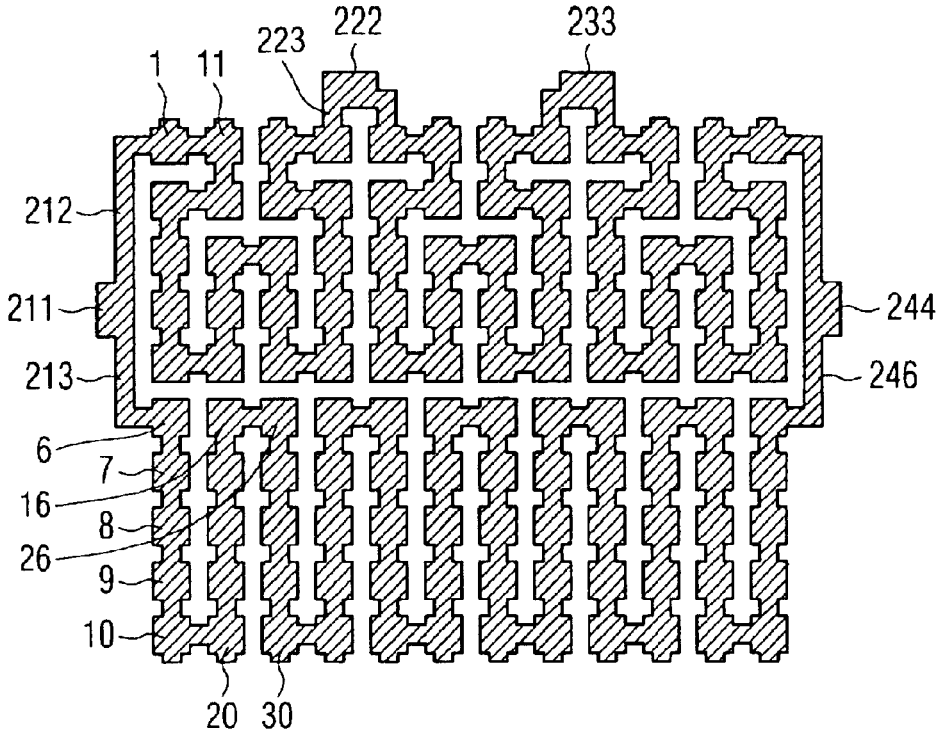
FIGS. 2A and 2B show an upper metal layer and a lower metal layer of a two-dimensional array of a miniaturized 5.4 GHz ring coupler microwave hybrid circuit manufactured using two-dimensional space.
Figure 2B:
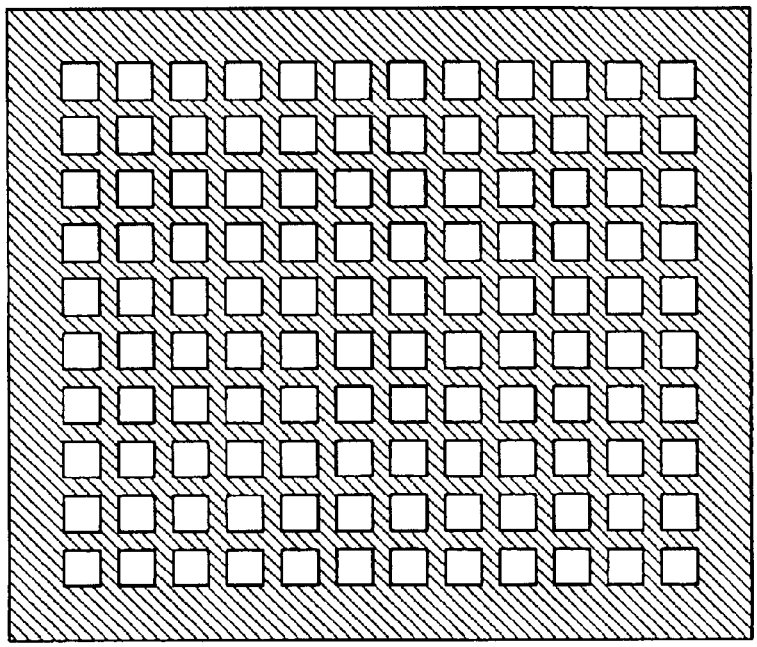

FIGS. 2A and 2B show diagrams of the upper metal layer and the lower metal layer of a two-dimensional array formed by unit cells in FIGS. 1A and 1B, respectively. When adjacent cells make close contact with one another, the four connecting arms (1*a*, 1*b*, 1*c* and 1*d* in FIG. 1A) of the upper metal layer (the right slanted lines) control transmission direction and propagation of signals, whereas the four loop connecting arms (1001*a*, 1001*b*, 1001*c* and 1001*d*) of the lower metal layer join together to form a so-called meshed or perforated ground plane with any point on the mesh ground plane being capable of directly conducting to any other point.

Referring to FIGS. 2A and 2B, except the connecting arms (1*a*, 1*b*, 1*c* and 1*d* in FIG. 1) of the upper metal layer (the right slanted lines), the upper-metal metal plane and the lower metal layer plane are complementary. Hence, the two-dimensional waveguide array shown in FIGS. 2A and 2B is called complementary conducting surfaces (CCS) for that the union of the upper metal layer and the lower metal layer at the array waveguide almost form a completely filled metal plane.

Propagation direction of the CCS waveguide is determined by joining at least two connecting arms (1*a*, 1*b*, 1*c* and 1*d* in FIGS. 1A or 1B) of each cell of the upper metal layer with surrounding adjacent cells, with electromagnetic energy at the CCS waveguide being quasi-TEM mode. Operations of the CCS waveguide shall be illustrated in two parts: the first part is wave propagation at the cells, and the second part is wave propagation at the connecting arms extending from the cells. Wave propagation at the cells is different from one-dimensional TEM transmission lines. Referring to FIG. 1B, it is assumed that signals are inputted from 1*c;* that is, a microwave signal source is disposed between the 1*c* area of the upper metal layer and the metal 1001*c* right below the 1*c* area of the cell. At the signal source, electric field is vertically present between the upper and lower metal layers. When signals start to propagate within the cell, the signals are divided into upward and downward directions. At this point, the electric field is no longer perpendicular to 1*c* and 1001*c*, but it is divided and tilted with respect to a direction perpendicular to the upper metal layer 1 and the lower metal layer 1001*c*, and is present between the upper and lower metal layers. Therefore, electromagnetic energy exists at an edge of the upper metal layer 1 and an edge of the lower metal layer 1001*c*, and is propagated toward directions 1001*b* and 1001*d*. Suppose 1*b* and 1*d* in FIG. 1B are absent, one of the two separated routes of electromagnetic energy travels along an edge of the upper metal layer 1 and an edge of the lower metal layer 1001*b*, whereas the other travels along an edge of the upper metal layer 1 and an edge of the lower metal layer 1001*d*. The two routes are joined at the upper metal layer 1*a* and the lower metal layer 1001*a*.

When electromagnetic energy is present at the edge of the upper metal layer 1 and the edge of the lower metal layer 1001*a* (*b, c* and *d*), the resulting capacitance is much lower than that observed at the signal source. The main reason is that, at the edge of the upper metal layer 1 and the edge of the lower metal layer 1001*a* (*b, c* and *d*), sectional areas for producing capacitance are also relatively decreased by large amounts. As mentioned in the above description, when electromagnetic waves propagate at the edges of the upper-layer and lower metal layers, the effective waveguide width is relatively decreased owing to utilization of the edges of the upper-layer and lower metal layers. Meanwhile, the distance between the upper and lower metal layers is also larger than the thickness of the substrate between the upper and lower metal layers. This physical occurrence correspondingly increases inductance. Therefore, with respect to propagation of electromagnetic waves within a cell, an equivalent circuit thereof can be regarded as a quasi-TEM transmission line having a comparatively higher characteristic impedance. For that dimensions of a cell are far less than a wavelength thereof in actual use, the equivalent circuit may be practically regarded as inductance. In addition, for a unit cell, according to the aforesaid embodiment in which signals are inputted from 1*c* and outputted from 1*a* in FIG. 1B, propagation of electromagnetic waves is not simply carried out from left to right in a direct manner, but it is distributed and carried out along the edges of the upper and lower metal layers to reach 1*a*. Hence, as far as the length of an equivalent transmission line is concerned, the equivalent length is increased, and wave velocity (wavelength) of the electromagnetic wave is equivalently decreased. As a result, the equivalent wave velocity is relatively slow.

Referring to FIG. 1B, when the electromagnetic energy enters or leaves the unit cell, its energy is confined in between the upper metal layer 1*c* and the lower metal layer 1001*c*, and between the upper metal layer 1*a* and the lower metal layer 1001*a*. At the moment, the waveguide structure formed by the upper metal layer 1*c*, the lower metal layer 1001*c*, and the media between them is microstrip. The characteristic impedance of the microstrip is much lower than that of the aforesaid corresponding waveguide structure in the unit cell. Similarly, the size of the microstrip portion is much smaller than the wavelength. Therefore, the equivalent circuit can be regarded as a capacitance.

Consequently, the entire two-dimensional CCS waveguide structure, being non-uniform along propagating direction, can be regarded as an L-C periodic structure. The main body of each unit cell can be regarded as inductance, and the connecting arms joining adjacent cells can be regarded as capacitance so as to create a two-dimensional L-C array.

Accompanied with changes in shapes of cells, the equivalent inductance changes as well. Meanwhile, the equivalent capacitance of the microstrip for joining cells similarly varies along with the width and length of the microstrip.

By changing shapes of the cells and dimensions of the microstrips; that is, the entire unit cell; the propagation characteristics of the periodic structure can be changed. Using FIGS. 2A and 2B as an example, a rat-race hybrid ring formed by an array of 10×12 cells has four ports 211, 222, 233 and 244. Signals are divided into upward and downward directions after inputted from the port 211. At first going downward, the signals travel to a cell 6 via a microstrip 213, pass through cells 7, 8, 9, 10 and 20, then travel upward to a cell 16, turn right to a cell 26, then travel downward to a cell 30, . . . , pass through a microstrip 246, and finally reach the port 244. A distance of the entire route from the port 211 to 244 is $$\frac{3}{4}\lambda_g.$$

Using the design of unit cells, magnitudes of the SWF ($\lambda_0/\lambda_g$) can be controlled by controlling the values of $\lambda_g$. It is should be noted that, without changing the thickness of a medium or a metal in the third dimension (vertical to the unit cells), the two-dimensional spacial design of the unit cells is used for controlling the SWF. The thickness of a medium and the thickness of a metal adhered thereon are generally defined by a hybrid or monolithic etching process. Therefore, it is a great advantage of the invention that, without changing the thicknesses of a substrate and a metal, the design of a unit cell is adjusted so as to change the SWF and the characteristic impedance of an entire L-C transmission line.

Departing from the port 211, a route having a distance of $$\frac{1}{4}\lambda_g$$

is formed by passing through the microstrip 212, the cells 1, 11, . . . , the microstrip 223 and to the port 222. A second route having a distance of $$\frac{1}{4}\lambda_g$$

is similarly formed to reach the port 233; and a third route having a distance of $$\frac{1}{4}\lambda_g$$

is again formed to reach the port 244. Thus, the 4-port circuit forms a prior ring coupler that is often applied in microwave mixer circuits.

Referring to FIGS. 2A and 2B, it shall be explained why the ring coupler circuit shown has dimensions much smaller than those of a conventional ring coupler microwave circuit.

As described in above, the total periphery length of the ring coupler hybrid circuit is $$\frac{6}{4}\lambda_g.$$

Suppose conventional microstrips are utilized, and a wavelength of a waveguide at a design frequency is $\lambda_{g1}$. The ring coupler hybrid circuit is designed using a conventional microstrip into a round shape as in the prior art, wherein the round shape has a radius of:

$$2\pi R_1 = \frac{6}{4}\lambda_{g1},\ R_1 = \frac{3\lambda_{g1}}{4\pi} \quad \text{equation (1)}$$

And hence the round shape has an area of:

$$A_1 = \pi R_1^2 = \pi\frac{9\lambda_{g1}^2}{16\pi^2} = \frac{9}{16\pi}\lambda_{g1}^2 \quad \text{equation (2)}$$

In addition, a three-dimensional CCS L-C array designed using the ring coupler circuit has an area of:

$$A_2 = \frac{6}{4}\lambda_{g2}P \quad \text{equation (3)}$$

wherein, $\lambda_{g2}$ is the equivalent wavelength of a transmission line formed by the aforesaid L-C array, and P is the period or the single-side width of the unit cell shown in FIG. 1.

An area reduction factor (ARF) is defined as $A_2/A_1$. Thus:

$$ARF = \frac{\frac{6\lambda_{g2}P}{4}}{\frac{9\lambda_{g1}^2}{\lambda}} = \frac{8\pi}{3}\frac{\frac{\lambda_o P}{SWF_{CCS}}}{\frac{\lambda_0^2}{SWF_{MS0}^{2\lambda}}} = \frac{8\pi}{3}\frac{P}{\lambda_0}\frac{SWF_{MS}^2}{SWF_{CCS}} \quad \text{equation (4)}$$

And, $$\lambda_{g1} = \frac{16\pi}{SWF_{MS}},\ \lambda_{g2} = \frac{SWF_{MS0}^{2\lambda}}{SWF_{CCS}},$$

wherein the SWF of the microstrip and the CCS transmission line are $SWF_{MS}$ and $SWF_{CCS}$, respectively.

A conventional 5.4 GHz ring coupler hybrid circuit and a 5.4 GHz CCS ring coupler hybrid circuit are fabricated by RO4003™ microwave printed circuit board (PCB) substrates at the same time. Each substrate has thickness of 203.2 μm, copper clad thickness of 17.5 μm, and $\epsilon_r$ of 3.38. The $SWF_{MS}$ of the conventional 70 Ω ($50\sqrt{2}$) microstrip transmission line is 1.6468.

The period P of the CCS unit cell is 450 μm, the dimensions of each unit cell at the upper metal layer are 300 μm×300 μm, and the length and width of the connecting arms 1*a*, 1*b*, 1*c* and 1*d* of the upper metal layer are 75 μm and 200 μm, respectively. The lower metal layer has the width of 75 μm, and the periphery length of P×4 (that is, 450 μm×4=1800 μm). Using the rigorous full-wave field theory simulations, $SWF_{CCS}$ of the CCS transmission line is calculated to be 1.335.

By substituting the above numbers into equation (4), it is obtained that ARF=13.78%. By identical substrates and process, the size of the entire conventional ring coupler hybrid circuit is reduced almost by 86.22%.

Observing the equation (4), it is apparent that reducing cell dimensions; that is, the period P; is a key point for reducing the area of a microwave hybrid circuit. To reduce P, it is essential that the following three factors be taken into consideration:

(a) limitations of PCB process: minimum line width, and minimum line spacing;

(b) CCS characteristic impedance; and (c) capability of transporting electric current.

Advanced with development of extremities of PCB process, pitches of PCBs are becoming smaller and smaller. Taking the aforesaid microwave substrate for instance, the smallest pitch thereof is approximately 150 μm, and thus the dimension or the cycle P of the unit cells is 450 μm. The line width can be reduced to 2 μm by using current complementary metal oxide semiconductor (CMOS) process if monolithic integrated circuit process is desired. By employing the above PCB design parameters and materials, the shape of the unit cell shown in FIGS. 1A and 1B precisely shows the 70 Ω characteristic impedence required by each transmission line of a ring coupler. As for the smallest line width of CCS (200 μm in this embodiment), the largest current is restricted.

Figure 3:
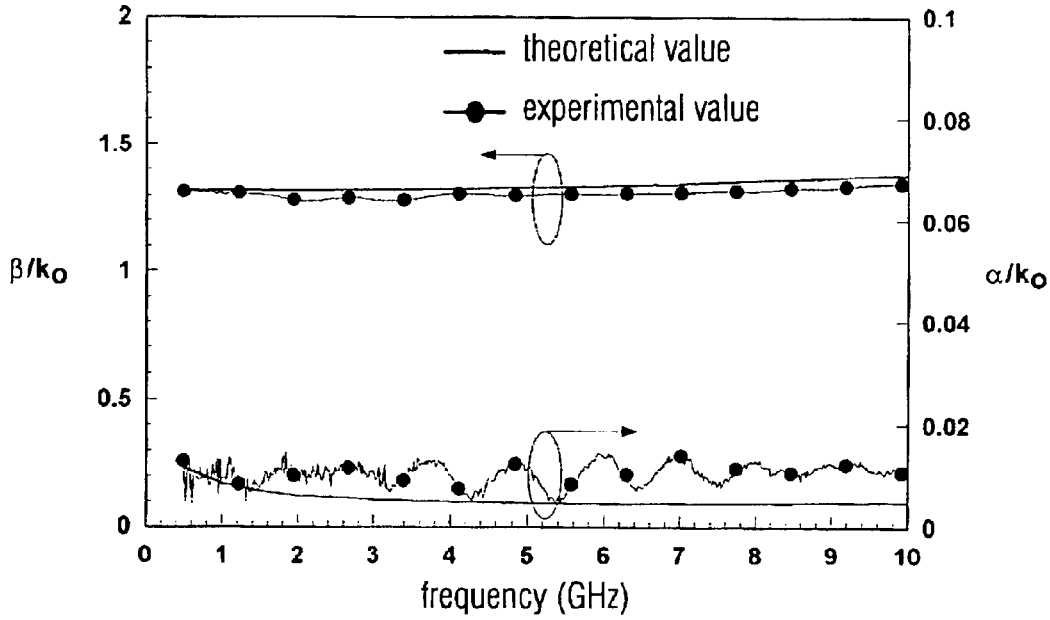
FIG. 3 is a diagram showing propagation constant dispersion characteristics of 70 Ω transmission lines.
Figure 4:
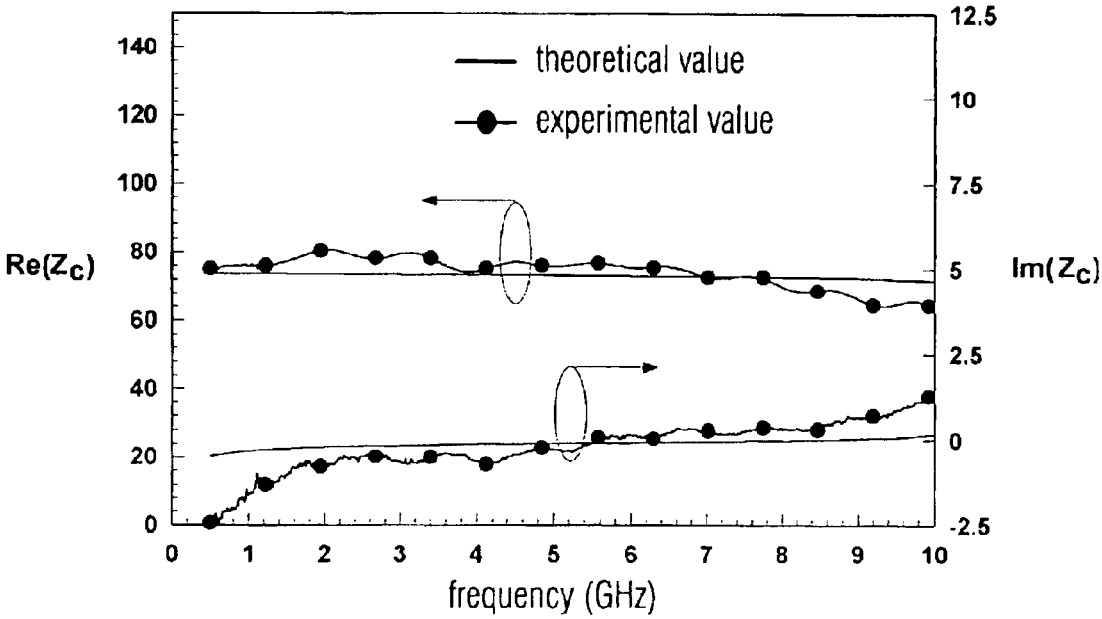
FIG. 4 is a curve diagram showing characteristic impedance versus frequency of 70 Ω transmission lines.

FIG. 3 shows dispersion characteristics of the CCS transmission line; that is, a diagram of propagation constant versus frequency. The left axis represents phase constant, and the right axis represents attenuation constant. Experimental values obtained agree well with theoretical values calculated from the full-wave field theory. FIG. 4 shows that theoretical and experimental values for characteristic impedence of the CCS transmission line are very close to the 70 Ω value to be designed.

Figure 5A:
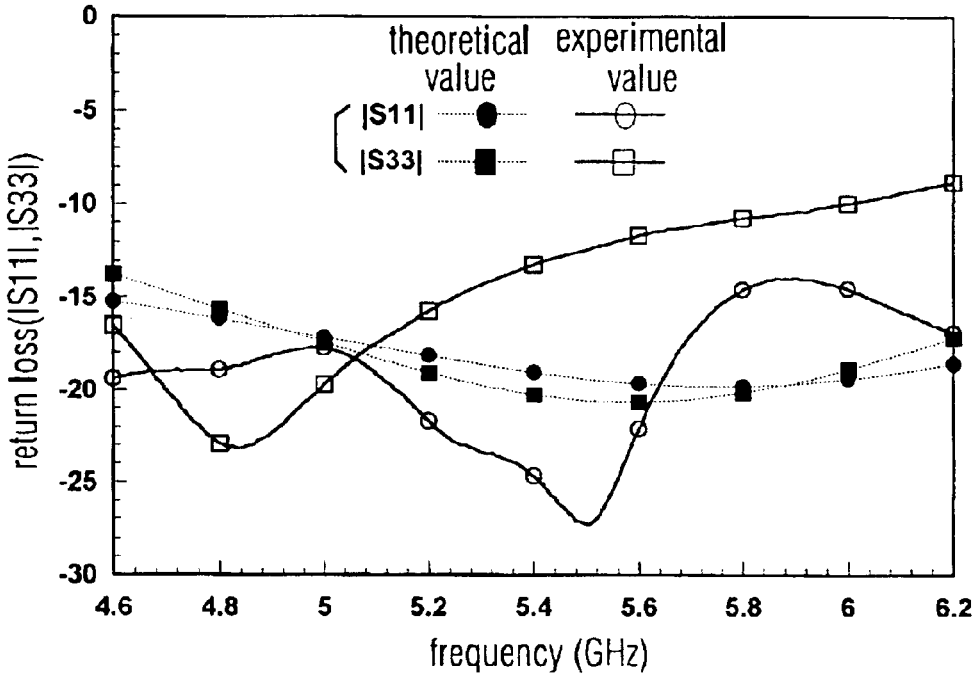
FIG. 5 is a curve diagram showing amplitude of scattering parameter versus frequency(a) return loss |S11| and |S33|, (b) isolation |S31|, and (c) coupling loss |S41| and |S43| of a prototypic CCS ring coupler circuit.
Figure 5B:
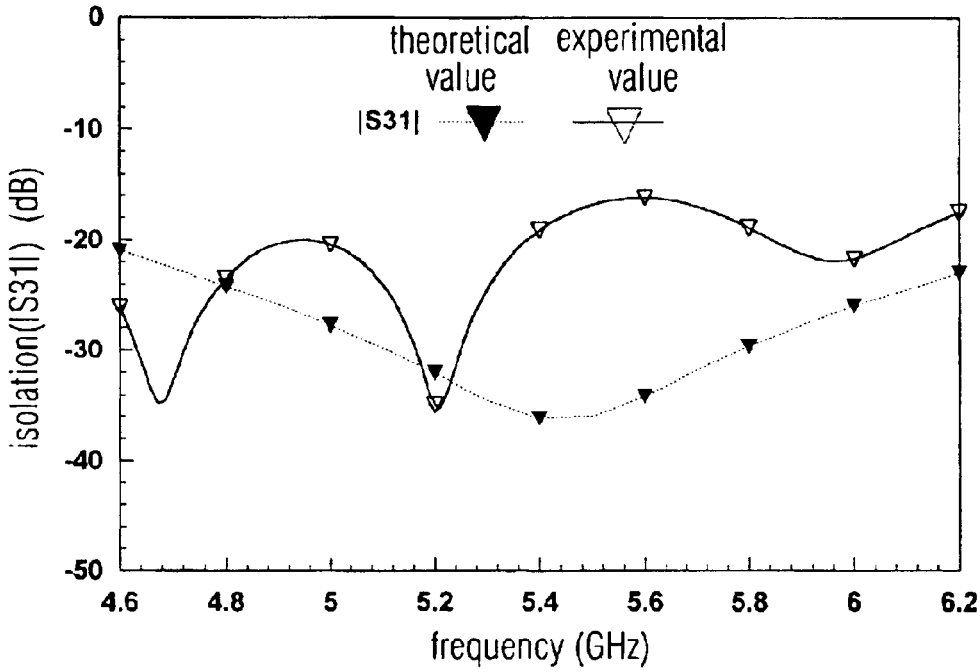
Figure 5C:
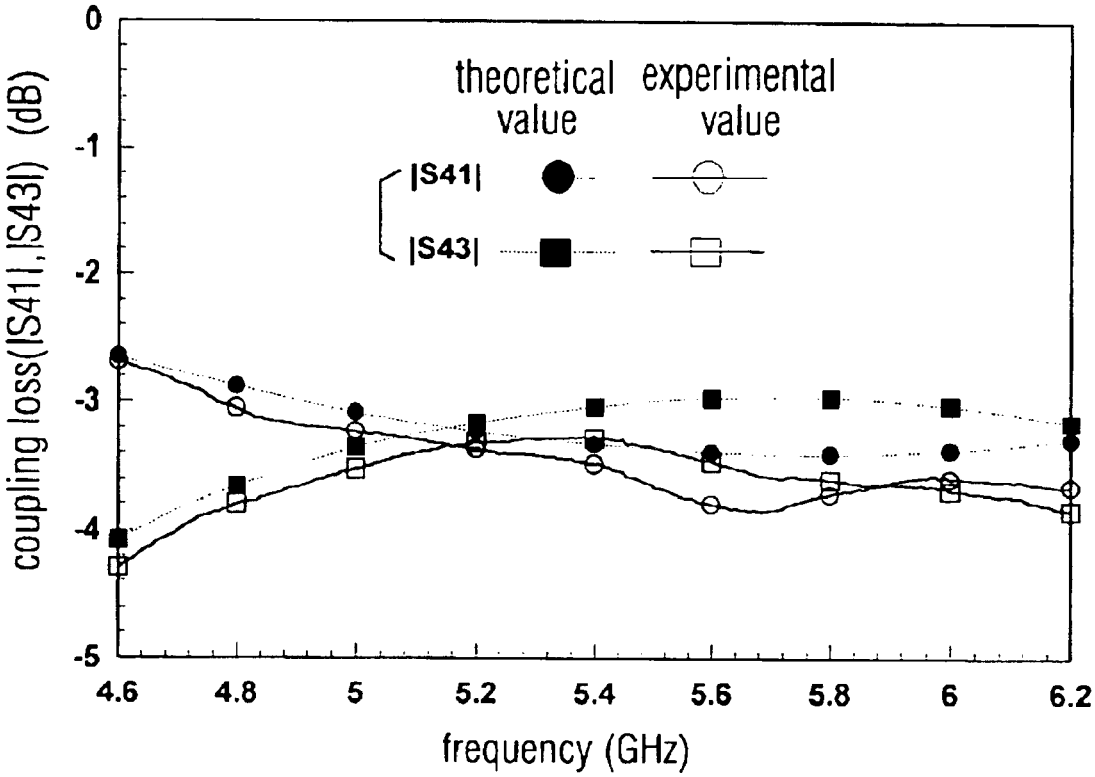
Figure 6:
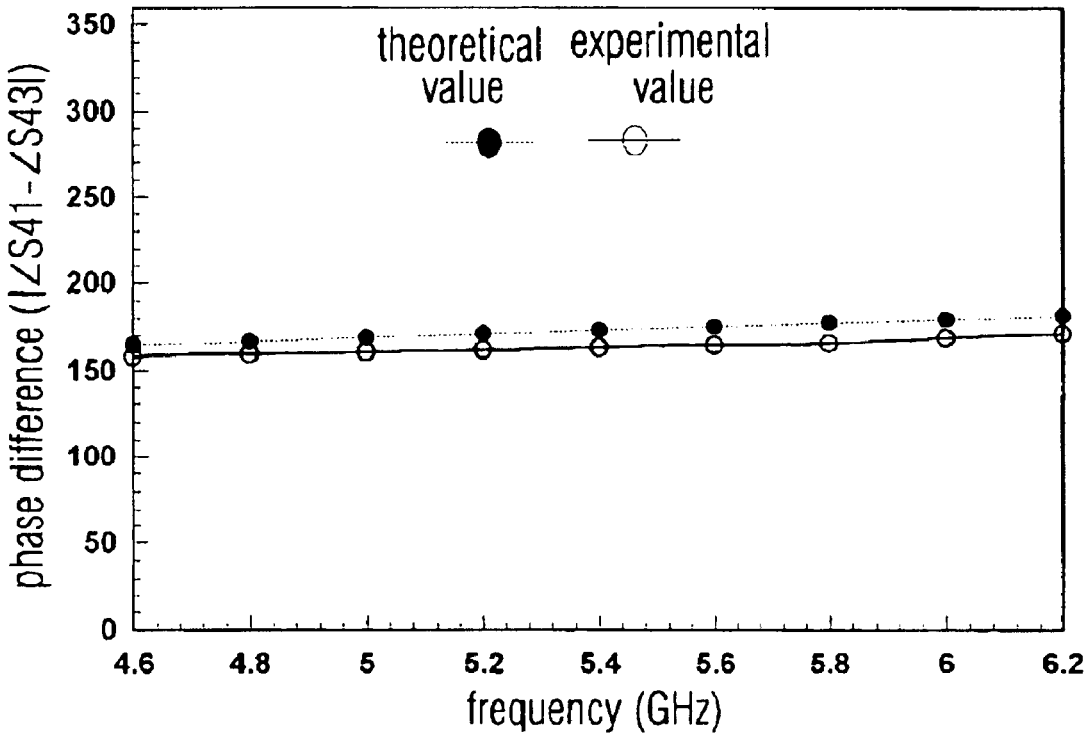
FIG. 6 is a curve diagram showing phase difference of scattering parameter versus frequency of a prototypic CCS ring coupler circuit.

Take the 3 dB hybrid circuit of the ring coupler shown in FIG. 2 as an example, suppose return loss is $S_{11}$ at port 1 (port 211), $S_{22}$ at port 2 (port 222), $S_{33}$ at port 3 (port 233), and $S_{44}$ at port 4 (port 244). The ports 1 and 3 are isolated ports for inputting signals. The port 2 is a Σ (sum) port, and the port 4 is a Δ (difference) port. The following numbers are calculated and measured as shown in FIGS. 5 and 6. FIGS. 5A and 5B show amplitude changes in scattering parameters of the CCS ring coupler prototype with respect to the return loss |S11| and |S33|, and the isolation |S41| and |S43|, respectively. FIG. 6 shows phase difference (|∠S41−∠S43|) changes in scattering parameters of the prototypic ring coupler according to frequency. From the information shown in FIGS. 5 and 6, it is concluded that numbers from theoretical deduction match experimental results. In addition, when port 211 and port 233 serve as input ports, port 222 and port 244 function as the sum port and the difference port, respectively. Hence, it is necessary that the port 211 and the port 233 be isolated to form each other.

Figure 7:
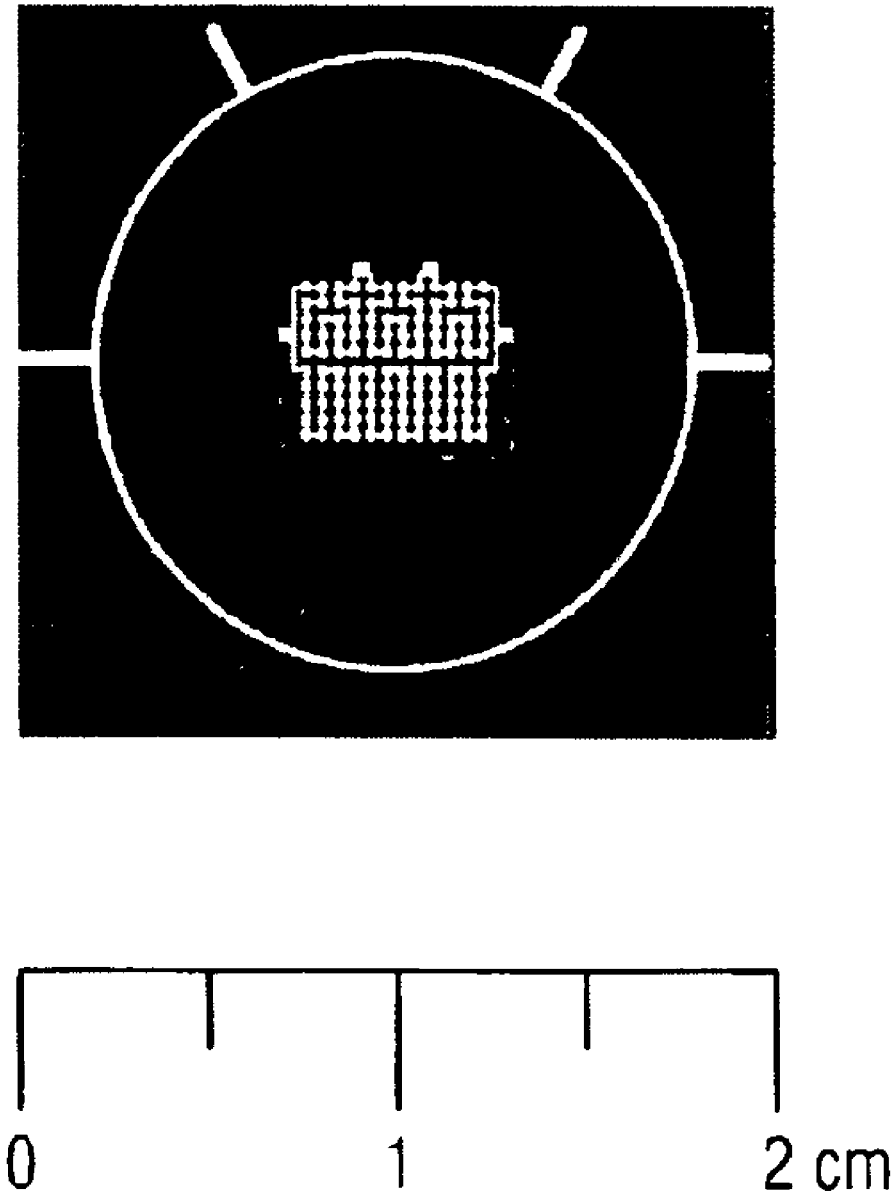
FIG. 7 is a comparison diagram showing a mask pattern of a prototypic CCS loop coupler circuit (inside) with a conventional microstrip ring coupler circuit (outside).

Referring to FIG. 7, during an experiment, a pattern of a mask made of a CCS two-dimensional structure is compared to that of conventional microstrip on a RO4003™ substrate simultaneously. An area of a ring coupler circuit designed from CCS two-dimensional waveguides (excluding four MSL feeds) is 12.27/100 of that of a ring coupler circuit designed from conventional microstrips, with the area coinciding with the value estimated by equation (4).

Figure 8A:
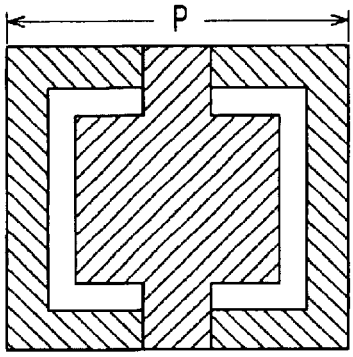
FIGS. 8A, 8B and 8C show a top view, a side view and an elevational view of an eight-metal-layer unit cell, respectively.
Figure 8B:
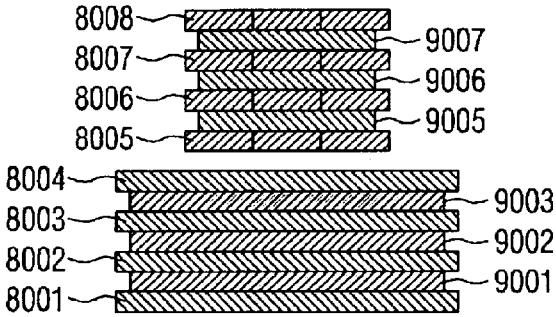
Figure 8C:
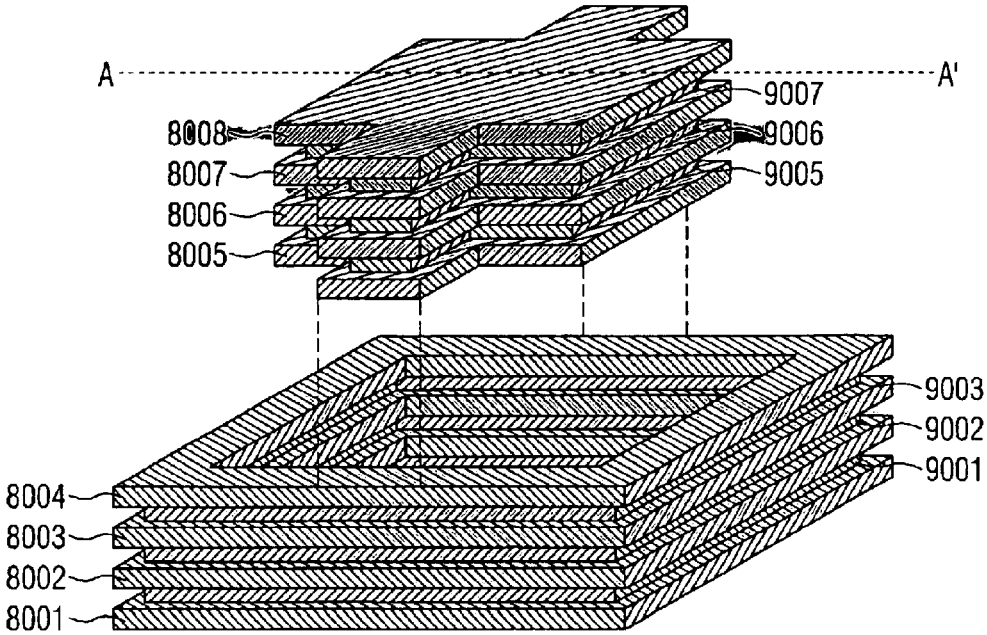
Figure 8D:
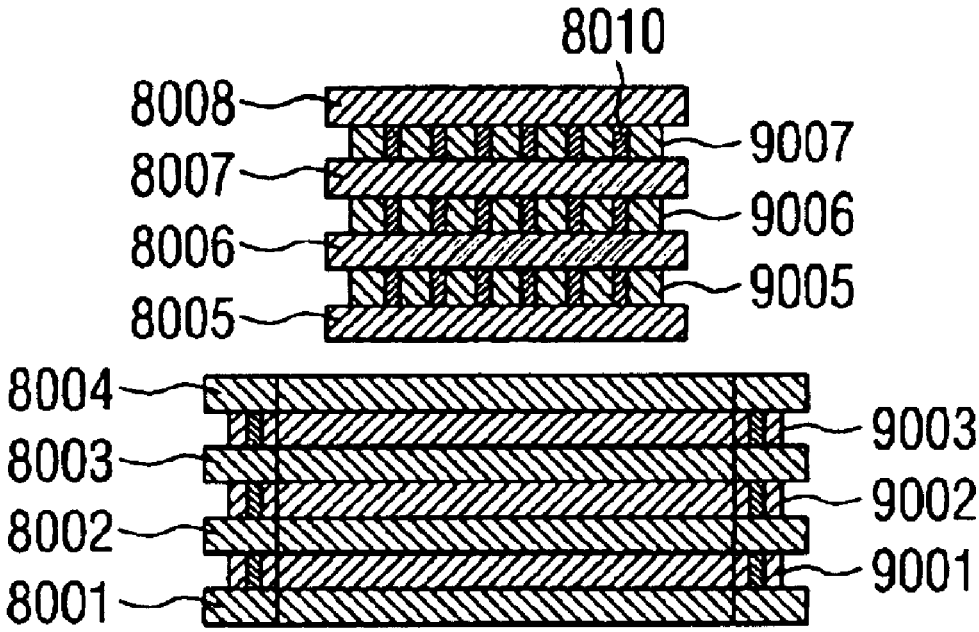
FIG. 8D shows the cross-sectional view along with line A–A" in FIG. 8C.

Accompanied with miniaturization and multi-layer metals in CMOS photolithography process and in multi-layer circuit board manufacturing process, the single-layer unit cells of the upper-layer and lower metal layers shown in FIGS. 1A and 1B can be extended into multi-layer metal designs. FIGS. 8A, 8B and 8C show a top view, a side view and an elevational view of a unit cell having eight metal layers, respectively. FIG. 8D shows the cross-sectional view along with line A–A" in FIG. 8C.

In this embodiment, lower four metal layers 8001, 8002, 8003 and 8004, and dielectric layers 9001, 9002 and 9003 lain in between, form a thick lower layer of a CCS two-dimensional waveguide structure. Four upper metal layers 8005, 8006, 8007 and 8008, and dielectric layers 9005, 9006 and 9007 lain in between, form an upper layer of the CCS two-dimensional waveguide structure. Each dielectric layer sandwiched between two upper metal layers or between two lower metal layers may be perforated with a plurality of openings and filled with metal, i.e., the conducting via 8010 as shown in FIG. 8D. Using such method, attenuation constant of the CCS waveguide metal loss with respect to the CCS two-dimensional waveguide is substantially reduced. Observed from the above, the design of the CCS unit cell formed by the eight metal layers is still similar to the figure of the unit cell shown in FIG. 1. However, there are two major distinctions:

(a) the upper and lower metal layers of the CCS unit cell are replaced by a multi-layer metal layer and dielectric layers having a plurality of openings filled with the metal; and (b) the dimension or the period P of the unit cell shown in FIGS. 8A, 8B, 8C and 8D is far smaller than those shown in FIGS. 1A and 1B because CMOS photolithography processes have higher precisions. In the embodiment shown in FIGS. 8A, 8B, 8C and 8D, the period P is as 28 μm.

[Second Embodiment]

Figure 9:
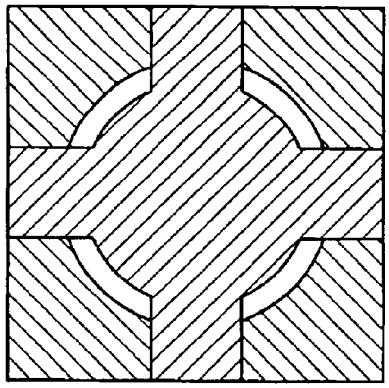
FIG. 9 shows a top view of a unit cell having a main body constructed using a round pattern.

FIG. 9 is another embodiment showing the shape of the unit cell. The main body in FIG. 1 is changed from being square in shape to round in shape, and the lower metal layer with a square-hole loop is replaced by that with a round-hole loop.

[Third Embodiment]

Figure 10A:
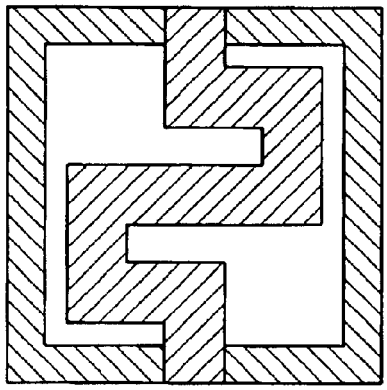
FIG. 10A shows a top view of a unit cell having a main body constructed using a reversed S-shaped pattern.

FIG. 10 shows the unit cell applied in pHEMT RFIC process for designing a wide-band traveling-wave amplifier (TWA). In the CCS unit cell, the area with lines from upper right to lower left, and the area with lines from upper left to lower right, represent the upper and lower metal layers of the two pHEMT metal layers. The area of the main body at the upper metal layer of the unit cell shown in FIG. 10A is a left-right swapped S shape for elevating impedance and thereby correspondingly increasing inductance.

[Fourth Embodiment]

Figure 10B:
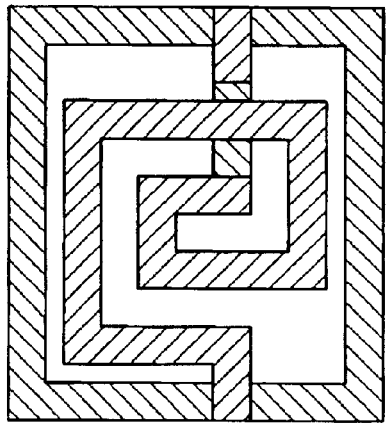
FIG. 10B shows a top view of a unit cell having a main body constructed using a reversed S-shaped pattern with a smaller width.

The unit cell shown in FIG. 10B has a similar design to that shown in FIG. 10A. However, due to the line width smaller than that of the left-right swapped S structure, the unit cell shown in FIG. 10B has higher impedance and larger inductance whereas it allows smaller electric current to pass through.

[Fifth Embodiment]

Figure 10C:
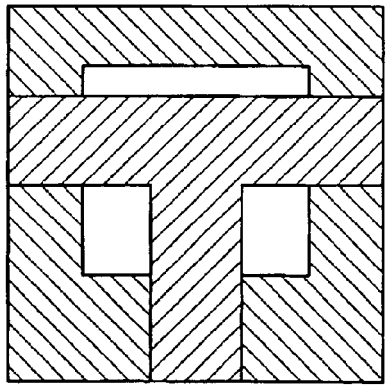
FIG. 10C shows a top view of a unit cell having a main body constructed using a T-junction pattern.
Figure 11:
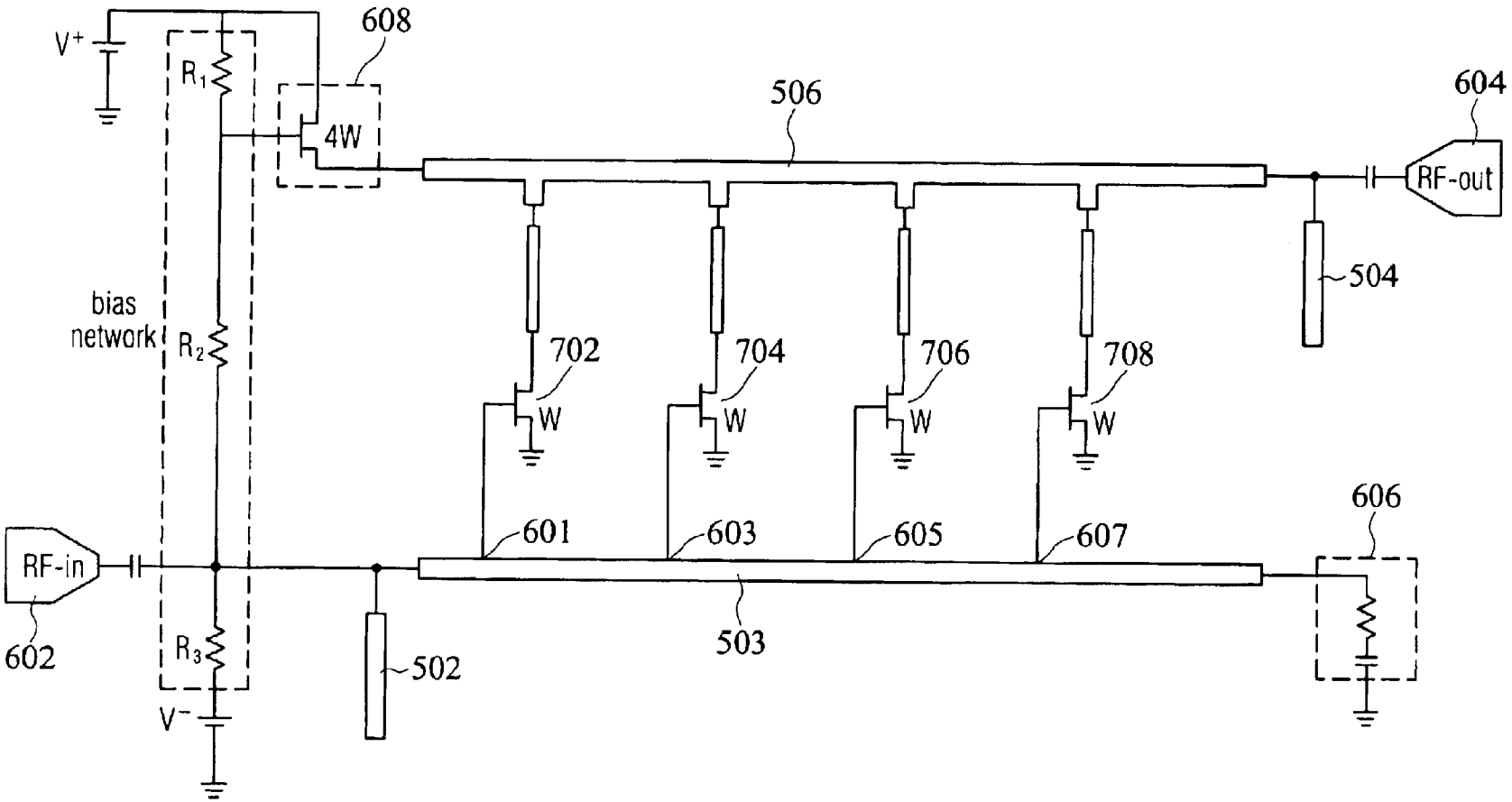
FIG. 11 shows a circuit diagram of a monolithic travel-wave amplifier (TWA).
Figure 12:
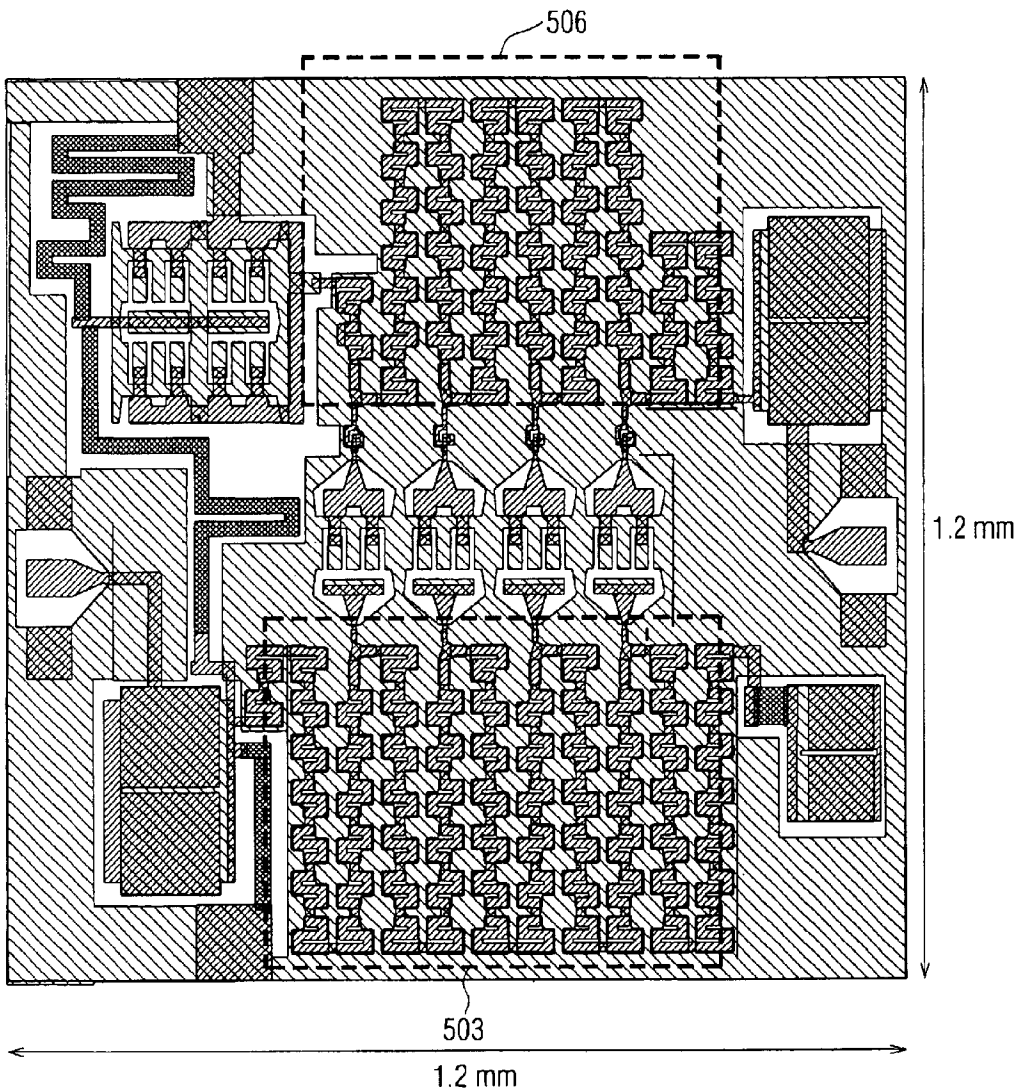
FIG. 12 shows a layout diagram of the chip in FIG. 11.
Figure 13:
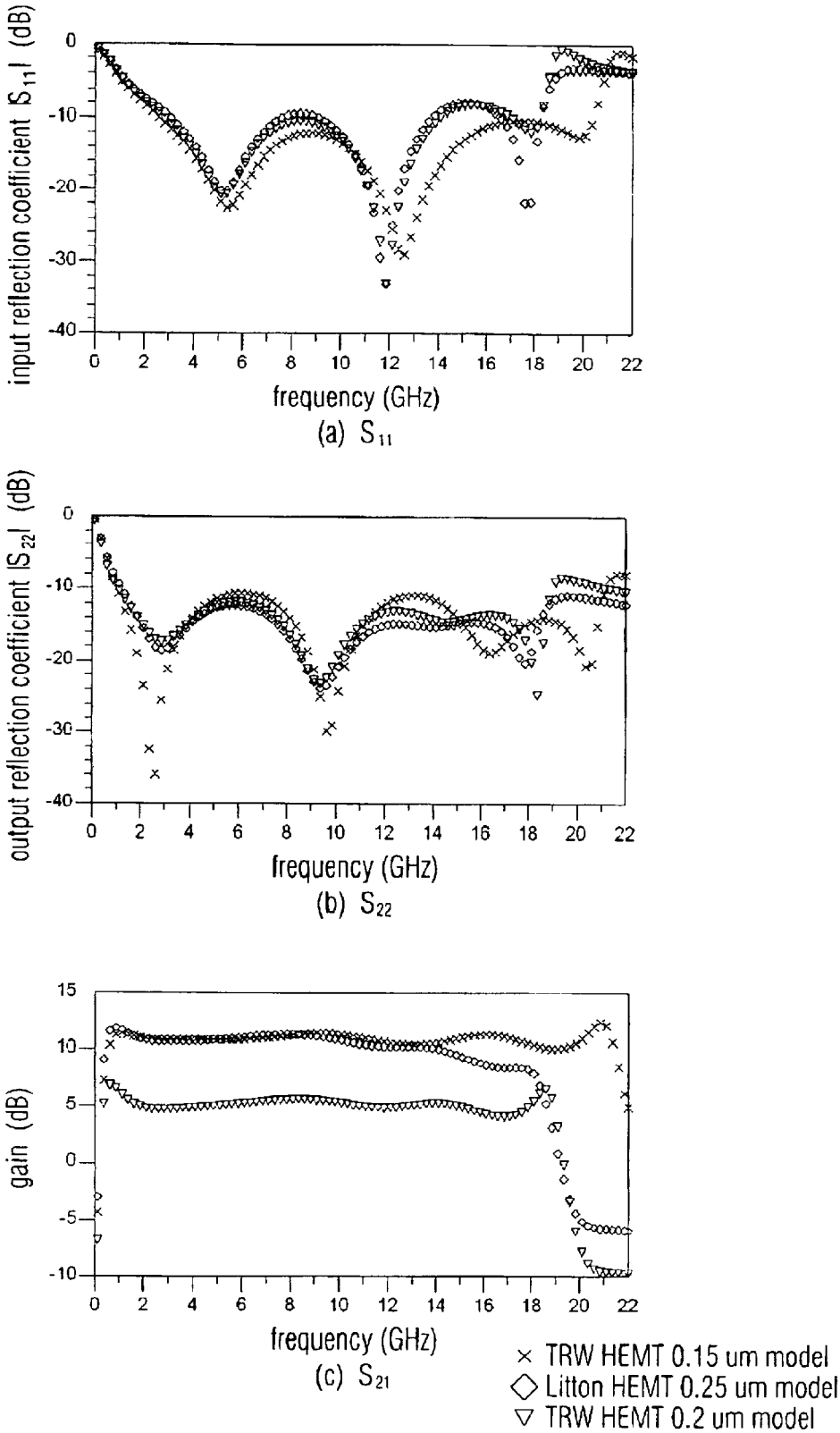

FIG. 10C shows a unit cell with a T-junction. Using combinations of the three abovementioned unit cells, the equivalent circuit of a pHEMT TWA monolithic integrated circuit is designed as shown in FIG. 11 and its design schematic layout is shown in FIG. 12. The simulation results are shown in FIGS. 13A, 13B and 13C. From the results of comparing the designed wide-band TWA with a commercialized pHEMT TWA (for example, TRW ALH1020C) having similar specifications, it is concluded that an area can be reduced from 3×1.435 $mm^2$ of the TRW chip to 1.2×1.2 $mm^2$. In the case of changing the process parameters, such as letting the gate length of the pHEMT increase from 0.15 μm to 0.25 μm, the gain and bandwidth of the amplifier are also varied as shown in FIGS. 13A, 13B and 13C due to the differences in the equivalent parasitic effect for individual transistor.

FIG. 11 shows a circuit diagram of a prototypic monolithic TWA, wherein all transmission lines thereof are completed by using CCS for achieving further area reduction of the integrated circuit. Via a CCS gate line 503, an RF-in input signal 602 is sent to a gate line termination 606. Along the pathway, points 601, 603, 605 and 607 send the signals to gates of pHEMT 702, 704, 706 and 708 by using the T-junction for further amplification. The amplified signal, after going through phase synchronization with a phase angle of the gate line equal to that of a drain line, is gathered at a CCS drain line 506. Half of the energy is passed to an RF-out 604 to be outputted, and the other half of the energy is forwarded to an active load 608 for appropriate termination, that is, the energy is absorbed at the location. The CCS open stubs 502 and 504 perform appropriate impedance matching at the gate line and the drain line. As shown in FIG. 12, the circuit layout of the aforesaid CCS transmission circuit in a pHEMT TWA can be illustrated in a practical design example. The CCS 503 and the CCS 506 are a gate line and a drain line, respectively; and have a layout that forms a two-dimensional array and is similar to that of the PCB layout of the ring coupler circuit shown in FIG. 2A and FIG. 2B, within signals meandering therein. The unit cells of the CCS 503 and the CCS 506 are constructed using the patterns in FIGS. 10A and 10C, and together with a bias circuit and solder pads, have a total area of 1.2 mm×1.2 mm. This particular 0.6 to 20 GHz amplifier has a gain of 11±1 dB, a power consumption of 157 mW, a noise figure of 4 dB, and an input and output reflection coefficient less than −10 dB ($V_{SWR} \leqq 2$). Among the documented pHEMT monolithic TWA RFIC with similar specifications, the smallest is TRW ALH1020C with an area of 3×1.435 $mm^2$. Such design using CCS transmission lines substantially reduces the slip size of TWA RFIC to as much as 60%.

Figure 14:
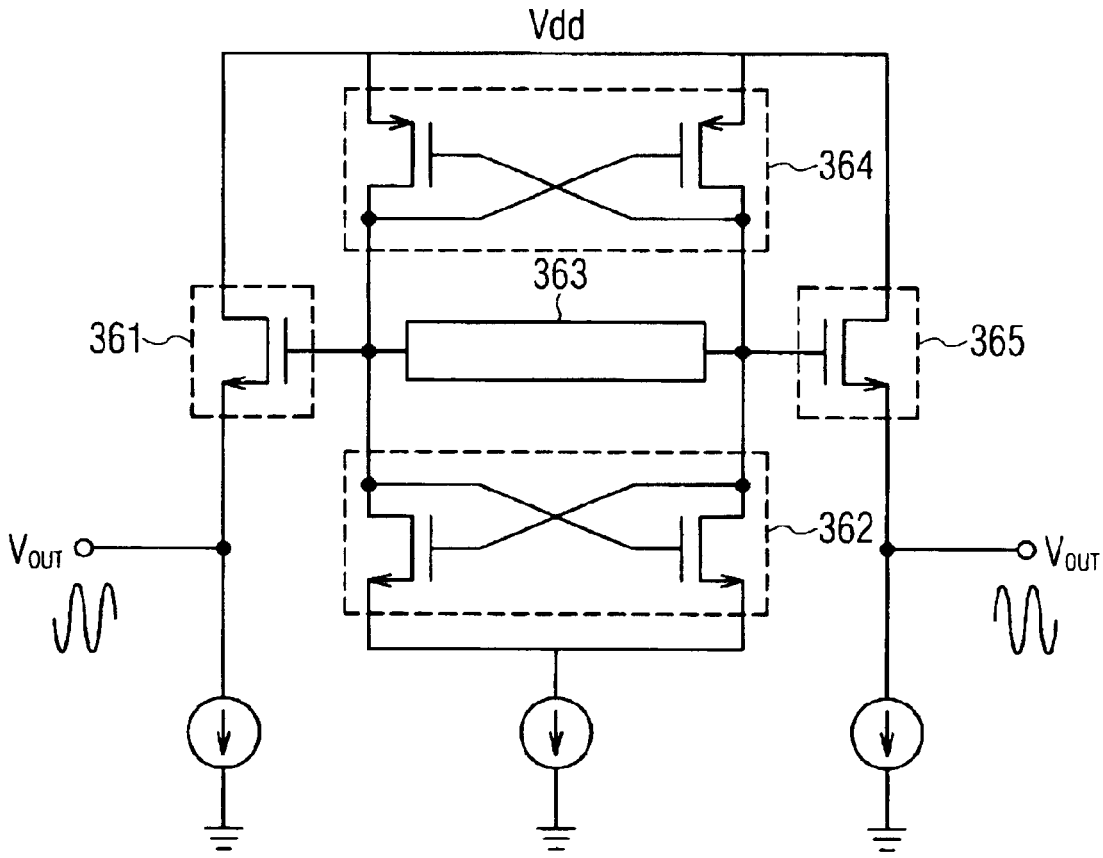
FIG. 14 shows a circuit diagram of an oscillator.
Figure 15:
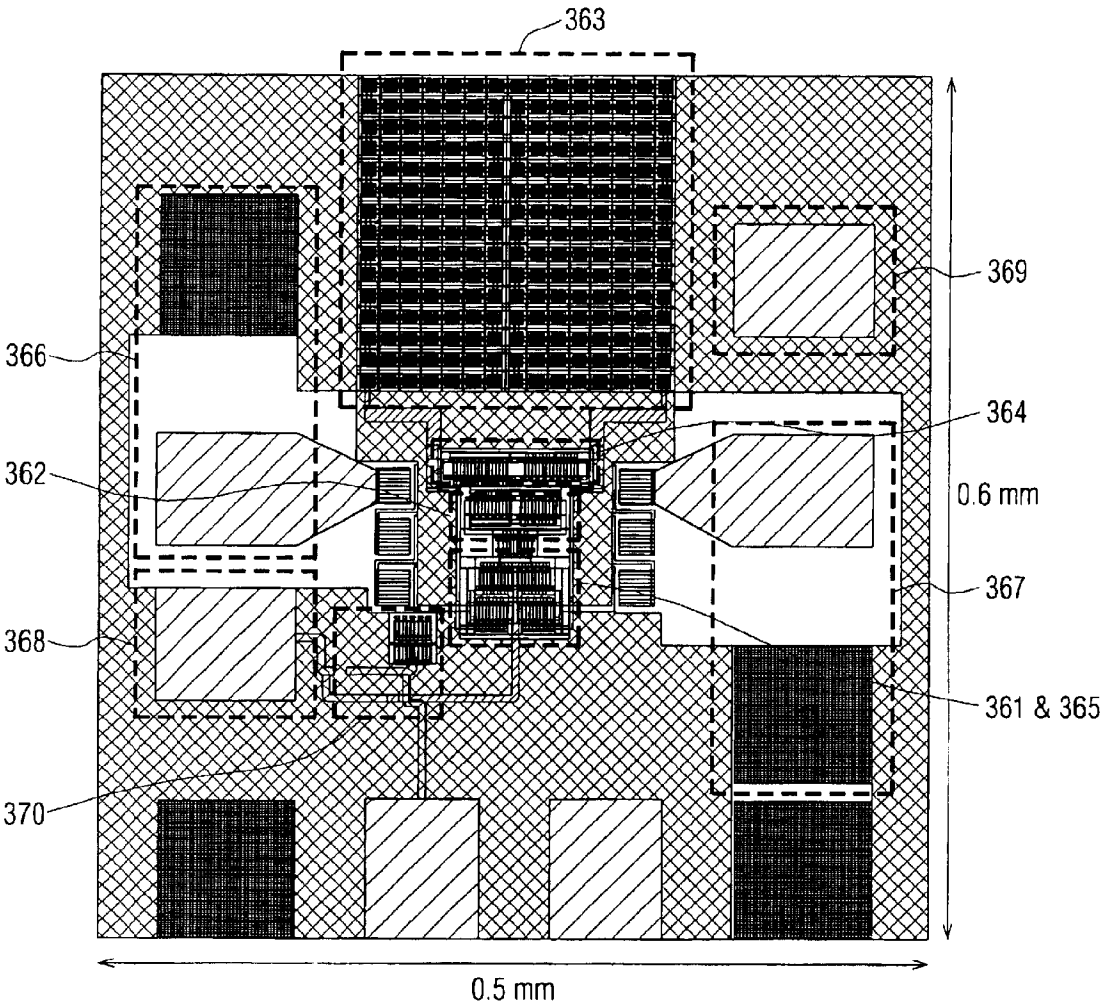
FIG. 15 shows a layout diagram of the chip shown in FIG. 14.
Figure 16B:
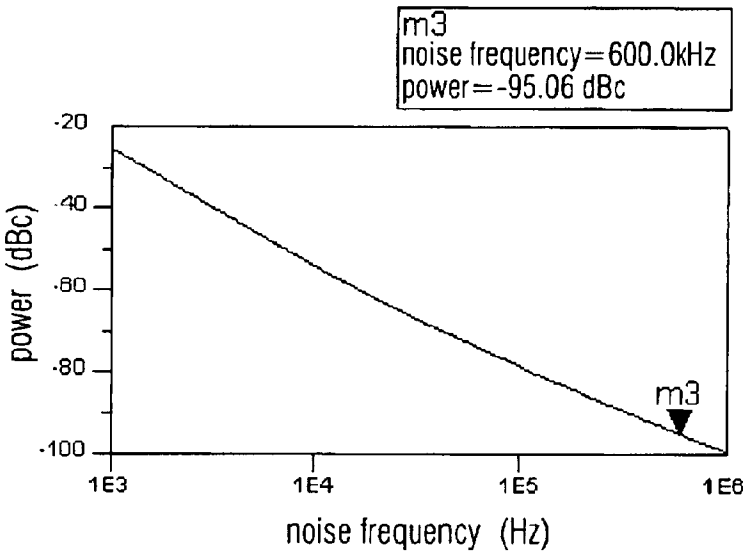
FIG. 16B shows phase noise of the oscillator.
Figure 16A:
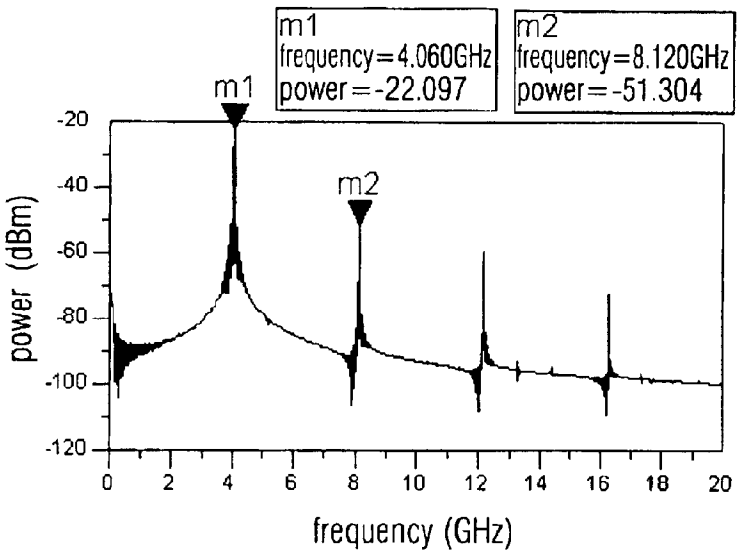
FIG. 16A shows a spectrum diagram of the RF output 366.

Another embodiment of CCS transmission line application in miniaturized integrated circuits shall be illustrated. Referring to FIG. 14 showing a microwave oscillator, two CMOS cross-coupled pairs 362 and 364 are used for producing a negative resistance, and oscillation is generated in conjunction with a CCS transmission line. A CCS transmission line 363 is formed using the square unit cell shown in FIG. 8A along with the multi-layer designs shown in FIGS. 8B, 8C and 8D. The CCS transmission line 363 resonates with the CMOS cross-coupled pair 362 and the CMOS cross-coupled pair 364 at an oscillation frequency. The particular frequency is determined by the CCS transmission line and parasitic capacitances of the CMOS cross-coupled pair 362, the cross-coupled pair 364, a buffer amplifier 361 and a buffer amplifier 365, and is largely depended on the CCS transmission line 363 for stability thereof. FIG. 15 shows a preferred embodiment illustrating a CMOS oscillator manufactured from TSMC 0.25 μm CMOS RFIC 5-layered metal process. Dimensions of a test chip are 0.5 mm×0.6 mm, with actual dimensions of the oscillator being merely 0.26 mm×0.45 mm. Two inverted outputs of the oscillator are outputted at a radio frequency (RF) output 366 and an RF output 367, wherein the RF output 366 and the RF output 367 are further outputted via the buffer amplifier 361 and the buffer amplifier 365. Referring to FIG. 15, a 2.5V direct-current (DC) voltage is inputted at a DC supply 368 and a DC supply 369. The DC supply 368 supplies current to a bias network 370, the buffer amplifier 361 and the buffer amplifier 365. The DC supply 369 supplies current to the CMOS cross-coupled pair 362 and the CMOS cross-coupled pair 364. According to the design manual of TSMC 0.25 μm CMOS RFIC, the RF output 366 and the RF output 367 are connected with a loading of 50 Ω and simulation results of ADS transient and harmonic balance using Agilent are indicated as in FIGS. 16A and 16B. FIG. 16A shows a spectrum diagram of the RF output 366 after performing Fourier transform with respect to the RF output 366. Output signals thereof oscillate at 4.06 GHz, while having an output power at −22.097 dBm and a $2^{nd}$ harmonic suppression of −29.207 dBc. FIG. 16B shows phase noise of the RF output 366 calculated by using ADS harmonic balance, and the simulation results indicate that the phase noise of the oscillator located at 600 KHz from a carrier is −95.06 dBc/Hz@600 KHz.

The embodiments and examples are fully illustrated as in the above descriptions in connection with the invention. For those who are skilled in this art, it is understood that modifications and variations from the above are apparent. Therefore, the above descriptions are illustrative but not limitative. Without departing from the true spirit and scope of the invention, various modifications and changes shall be included by the appended claims of the invention.

What is claimed is:

1. A two-dimensional array waveguide structure implemented using multi-layer circuit board manufacturing process, comprising:

a first metal layer consisted of at least a first sub metal layer; wherein, adjacent first sub metal layers are isolated by a dielectric layer lain in between, the dielectric layer is perforated with a plurality of openings filled with metal, each first sub metal layer is formed by a plurality of first unit cells arranged in rows and columns to form a two-dimensional array structure, and each first unit cell has a main body and a plurality of connecting arms joining adjacent first unit cells;

a second metal layer consisted of at least a second sub metal layer; wherein, adjacent second sub metal layers are isolated by a dielectric layer lain in between, the dielectric layer is perforated with a plurality of openings filled with a metal, each second sub metal layer is formed by a plurality of second unit cells arranged in rows and columns to form a two-dimensional array structure, the second metal layer is situated below the first metal layer, each second unit cell is corresponding to individual first unit cell in a one-on-one manner, and adjacent second unit cells are joined with one another, and each second unit cell is made of a metal wire loop; and a dielectric layer provided between the second metal layer and the first metal layer to isolate the second metal layer from the first metal layer.

2. The two-dimensional array waveguide structure as described in claim 1, wherein the main body of each unit cell is non-overlapping or partially overlapping with the metal wire loop of each second unit cell, and the connecting arms of each first unit cell are overlapping or partially overlapping with the metal wire loop of each second unit cell.

3. The two-dimensional array waveguide structure as described in claim 1, wherein the main body and the connecting arms of each first unit cell are square in shape, and each second unit cell corresponding with individual first unit cells is formed by a square metal wire loop.

4. The two-dimensional array waveguide structure as described in claim 1, wherein the main body of each first unit cell is round in shape whereas the connecting arms thereof are square in shape, and each second unit cell corresponding to individual second unit cell is formed by a metal wire loop that has an outer periphery being square in shape and an inner side being round in shape.

5. The two-dimensional array waveguide structure as described in claim 1, wherein the main body of each first unit cell is a left-right swapped S shape and the connecting arms thereof square in shape, and each second unit cell corresponding to individual second unit cell is formed by a square metal wire loop.

6. The two-dimensional array waveguide structure as described in claim 1, wherein the main body of each first unit cell is a T shape and the connecting arms thereof are square in shape, and each second unit cell corresponding to individual second unit cell is formed by a square metal wire loop.

7. The two-dimensional array waveguide structure as described in claim 1, wherein the dielectric layer is made of a material selected from a compound having polyimide, $Si_3N_4$, plastic, PTFE and ceramic.

8. A two-dimensional array waveguide structure implemented using monolithic integrated circuit manufacturing process, comprising:

a first metal layer consisted of at least a first sub metal layer; wherein, adjacent first sub metal layers are isolated by a dielectric layer lain in between, the dielectric layer is perforated with a plurality of openings filled with a metal, each first sub metal layer is formed by a plurality of first unit cells arranged in rows and columns to form a two-dimensional array structure, and each first unit cell has a main body and a plurality of connecting arms joining adjacent first unit cells;

a second metal layer consisted of at least a second sub metal layer; wherein, adjacent second sub metal layers are isolated by a dielectric layer lain in between, the dielectric layer is perforated with a plurality of openings and filled with a metal, each second sub metal layer is formed by a plurality of second unit cells arranged in rows and columns to form a two-dimensional array structure, the second metal layer is situated below the first metal layer, each second unit cell is corresponding to individual first unit cell in a one-on-one manner, and adjacent second unit cells are joined with one another, and each second unit cell is made of a metal wire loop; and a dielectric layer placed between the second metal layer and the first metal layer to isolate the second metal layer from the first metal layer.

9. The two-dimensional array waveguide structure as described in claim 8, wherein the main body of each first unit cell is non-overlapping or partially overlapping with the metal wire loop of each second unit cell, and the connecting arms of each first unit cell are overlapping or partially overlapping with the metal wire loop of each second unit cell.

10. The two-dimensional array waveguide structure as described in claim 8, wherein the main body and the connecting arms of each unit cell are square in shape, and each second unit cell corresponding with individual first unit cells is formed by a square metal wire loop.

11. The two-dimensional array waveguide structure as described in claim 8, wherein the main body of each first unit cell is round in shape whereas the connecting arms thereof are square in shape, and each second unit cell corresponding to individual second unit cell is formed by a metal wire loop that has an outer periphery being square in shape and an inner side being round in shape.

12. The two-dimensional array waveguide structure as described in claim 8, wherein the main body of each first unit cell is a left-right swapped S shape and the connecting arms thereof square in shape, and each second unit cell corresponding to individual second unit cell is formed by a square metal wire loop.

13. The two-dimensional array waveguide structure as described in claim 8, wherein the main body of each first unit cell is a T shape and the connecting arms thereof are square in shape, and each second unit cell corresponding to individual second unit cell is formed by a square metal wire loop.

14. The two-dimensional array waveguide structure as described in claim 8, wherein the dielectric layer is made of a material selected from a compound having polyimide, $Si_3N_4$, plastic, PTFE and ceramic.

* * * * *